US005989098A

United States Patent [19]

Reynolds et al.

[11] Patent Number: 5,989,098

[45] Date of Patent: Nov. 23, 1999

[54] AUDIO VISUAL DISPLAY APPARATUS AND KIT

[76] Inventors: Peter Reynolds, P.O. Box 240, North Conway, N.H. 03860; Bruce Poole, P.O. Box 551, Intervale, N.H. 03845

[21] Appl. No.: 09/248,592

[22] Filed: Feb. 11, 1999

[51] Int. Cl.[6] ..... A63H 33/26

[52] U.S. Cl. ..... 446/485; 446/484; 446/228; 446/227; 40/455

[58] Field of Search ..... 211/85.8; 434/308, 434/309, 311; 446/175, 227, 228, 404, 484, 485; 40/431, 452, 455, 717

[56] References Cited

U.S. PATENT DOCUMENTS

| | | | |
|---|---|---|---|
| 4,373,918 | 2/1983 | Berman | 434/309 |
| 4,984,380 | 1/1991 | Anderson | 40/455 |
| 5,209,665 | 5/1993 | Billings . | |
| 5,277,588 | 1/1994 | Lin . | |
| 5,359,374 | 10/1994 | Scwartz | 40/455 |
| 5,511,980 | 4/1996 | Wood . | |
| 5,611,694 | 3/1997 | Brumley . | |
| 5,671,555 | 9/1997 | Fernandes . | |
| 5,758,777 | 6/1998 | Dods . | |
| 5,883,341 | 3/1999 | Terriss et al. | 40/455 |

*Primary Examiner*—Sam Rimell
*Attorney, Agent, or Firm*—Michael J Persson; William B. Ritchie

[57] ABSTRACT

The invention is an apparatus for displaying collectibles and a kit for use with the apparatus. In its most basic form, the apparatus of the present invention includes a display dimensioned for receiving said at least one collectible, at least one light generating device for illuminating the collectible when received within the display, and a controller. The controller includes a sound generating device for generating at least one predetermined sound, a light control for activating a predetermined one of said at least one light generating device corresponding to the predetermined sound, and a control module having a user interface for sending a light control signal to the light control, and a sound control signal to the sound generating device, each corresponding to a collectible selected by a user. In operation, a user selects a desired collectible on the user interface causing the control module to send a control signal to the light control and to the sound generating device. In response to the control signals, a corresponding light generating illuminates the desired collectible and the sound generating device generates a sound or other audio clip corresponding to the desired collectible.

20 Claims, 5 Drawing Sheets

AUDIO VISUAL DISPLAY APPARATUS AND KIT

FIELD OF THE INVENTION

The present invention relates generally to an audio-visual display apparatus and more specifically to a display apparatus that illuminates a collectible and plays a recorded statement or sound that correlates with the illuminated collectible.

BACKGROUND OF THE INVENTION

Over the past ten years, collectibles such as baseball cards, figurines, photographic and artistic likeness', models, plates, stamps and the like have increased in popularity and in value. People commonly display their collectibles in the home using display devices, such as cases, shelf-units, wall mounting brackets, and frames. However, to people who are not collectors, or are unaware of the significance of a particular person or thing that the collectible represents, these objects have little meaning. This problem can be solved by the owner explaining the significance, or through the use of written literature, such as would be found in an art gallery. However, these solutions are unsatisfactory as the owner may not always be present and, in many cases, there is insufficient space to provide written literature. Thus, there is a need for a way to provide information about displayed collectibles to inform both non-collectors and collectors of the significance of a given collectible, when an owner is not present, that does not involve the provision of written information.

Presently, there are a number of different display methods and a number of methods for relaying information about an image or likeness. Many of these methods feature lights and sound associated with video images, or feature one-piece audio-visual display units. However, none of the present methods are readily adapted for providing information about displayed collectibles.

One group of issued patents relating to display apparatus features sounds that correspond to video images or pictures. For example, U.S. Pat. No. 4,373,918, issued to Berman, on Feb. 15, 1983, U.S. Pat. No. 5,611,694, issued to Brumley, on Mar. 18, 1997, U.S. Pat. No. 5,671,555, issued to Fernandes, on Sep. 30, 1997, U.S. Pat. No. 5,209,665, issued to Billings, on May 11, 1993, and U.S. Pat. No. 5,359,374, issued to Schwartz, on Oct. 25, 1994. In each of these patents, the sound generating device is not separated from the likeness. Therefore, a particular likeness cannot intrinsically be displayed as a decoration. Also, none of these displays allow users to display likenesses in embodiments other than video images or pictures, preventing the use of these apparatus for display of collectibles such as figurines or other three dimensional objects.

Another group of issued patents disclose displays directed to a particular likeness, figurine, or other object. However, none of these patents describes an apparatus that is interactive. One example of these displays is found in U.S. Pat. No. 5,758,777, issued to Dods, on Jun. 2, 1998. Dods discloses a package comprising a figurine and a model book or a model magazine bearing information relating to the figurine. The model book or the model magazine preferably comprises a small replica comic book featuring a character represented by the figurine, with the preferred embodiment including a display stand for the figurine. This type of arrangement succeeds in providing information about the figurine, but requires the inclusion of written materials. Thus, this system fails to solve the problem described above.

Finally, there is a group of prior display patents that feature sound generation and the option of interchanging likenesses. Examples of these include U.S. Pat. No. 5,277,588, issued to Lin, on Jan. 11, 1994 and U.S. Pat. No. 5,511,980, issued to Wood, on Apr. 30, 1996, U.S. Pat. No. 5,277,588, issued to Lin, on Jan. 11, 1994 and U.S. Pat. No. 5,511,980, issued to Wood, on Apr. 30, 1996. 1however, each of these requires that the sound generator be directly attached to the figurine and, accordingly do not provide any means for identifying a figurine that is remotely displayed. Another drawback of these devices is that the direct attachment of the sound generator to the figurine eliminates the ability to easily provide updated information about a figurine as time goes by.

An apparatus for providing information about displayed collectibles, to inform both non-collectors and collectors of the significance of the collectible, that does not require the provision of written information, that allows the collectibles to be remotely displayed, that may be utilized with both three dimensional and two dimensional collectibles, and that allows information about a collectible to be easily updated, is not known in the art.

SUMMARY OF THE INVENTION

The invention is an apparatus for displaying collectibles and a kit for use with the apparatus. In its most basic form, the apparatus of the present invention includes a display dimensioned for receiving at least one collectible, a light generating device for illuminating each collectible when received within the display and a controller. The controller includes a sound generating device for generating at least one predetermined sound corresponding to a predetermined collectible, a light control for activating a predetermined light generating device corresponding to the predetermined collectible, and a control module having a user interface for sending a light control signal to the light control, and a sound control signal to the sound generating device each corresponding to a collectible selected by a user.

In operation, a user selects a desired collectible on the user interface causing the control module to send control signals to the light control and to the sound generating device. In response to the control signals, a corresponding light generating device illuminates the desired collectible and the sound generating device generates a sound or other audio clip corresponding to the desired collectible.

The controller of the preferred apparatus includes a control module having a plurality of removable computer sound chips programmed with predetermined sounds corresponding to a displayed collectible. In the preferred embodiment, each computer chip includes identification marking for relating the chip to a corresponding collectible.

The preferred controller includes a sound generating device having at least one speaker in communication with the computer sound chips and a volume control for adjusting the volume of the sounds generated by the speaker. In some embodiments, at least one computer sound chip includes a delay that prevents the control module from sending the sound control signal for a predetermined time after sending the light control signal.

The preferred control module includes a user interface that allows the user to easily select a collectible and simultaneously send signals to the sound generating device to activate a corresponding computer sound chip, and to the light control to illuminate the collectible. In some embodiments, the control module is adapted to provide a delay to either the light control signal or to the sound control signal. In other embodiments, the control module is adapted to send a series of sound signals to generate a predetermined sound a predetermined number of times.

The preferred light control includes a wire connected from the control module to each light generating device for electrically powering an incandescent bulb that serves as the light generating device. In other embodiments, however, the light control is a fiber optic cable that channels light directly from the controller through an end of the fiber optic cable that serves as the light generating device. In still other embodiments, the light control is a remote control utilizing infrared, or radio frequency, communication between the display module and controller. In these embodiments, a signal is sent from the controller to a receiver, in electrical communication with the light generating devices, that causes a chosen collectible to be illuminated.

The preferred display is a mobile that allows collectibles to be removably hung. In these embodiments, the mobile includes a plurality of hangers, each attached to a collectible and to a light generating device. In other embodiments, the display is a shelving unit having a series of compartments dimensioned to receive a collectible. In these embodiments, it is preferred that a light generating device be disposed within each compartment.

The kit of the present invention includes a collectible, dimensioned for receipt by a given display, and a computer sound chip programmed with a predetermined sound corresponding to the collectible. The kit is adapted for use with the apparatus and allows a variety of collectibles, and corresponding sound chips, to be purchased and displayed. In some embodiments of the kit, the collectible and sound chip include identification marking for correlating the collectible with the sound chip.

Therefore, it is an aspect of the present invention to provide a lighted display apparatus for collectibles.

Another aspect of the present invention is to provide a display apparatus for collectibles that integrates a remote sound system.

Another aspect of the present invention is to provide a display apparatus with a sound system that may be altered to accommodate a particular collectible.

A further aspect of the present invention is to provide a remotely controlled display apparatus for collectibles.

Another aspect of the present invention is to provide a display apparatus that accommodates interchangeable sets of collectibles.

Another aspect of the present invention is to provide a display apparatus that accommodates interchangeable sound chips.

Another aspect of the present invention is to provide a portable display apparatus for collectibles.

Another aspect of the present invention is to provide a display apparatus that may suspend collectibles from a mobile.

It is a further aspect of the present invention to provide a kit for updating collectibles and sound chips utilized by the apparatus of the present invention.

It is another aspect of the present invention to provide a kit that includes identification marking on the collectible and sound chip to correlate the collectible with the sound chip.

These aspects of the invention arc not meant to be exclusive and other features, aspects, and advantages of the present invention will be readily apparent to those of ordinary skill in the art when read in conjunction with the following description, appended claims and accompanying drawings.

DETAILED DESCRIPTION OF THE DRAWINGS

Figure 1:
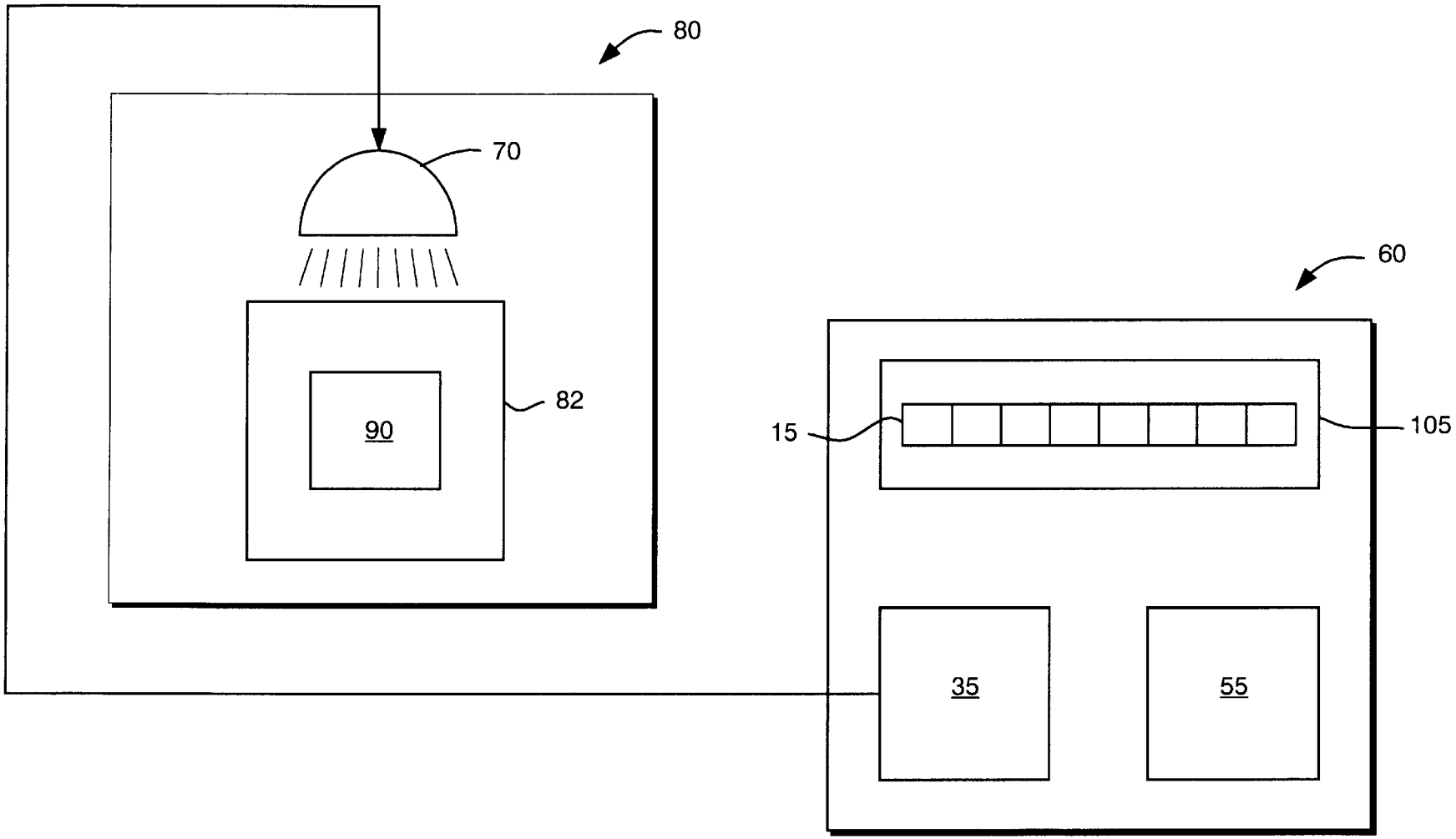
FIG. 1 is a block diagram of the basic embodiment of the apparatus of the present invention.

Referring to FIG. 1, a block diagram of the basic embodiment of the apparatus of the present invention is shown. As shown in FIG. 1, the basic includes two main components; a controller 60 and a display module 80.

The display module 80 includes a display 82, dimensioned for receiving said at least one collectible 90, and at least one light generating device 70 for illuminating the collectible 90 when it is received within the display 82. Display 82 is dimensioned to receive at least one collectible 90 and may be in the form of a case, a shelf-unit, a wall bracket, a frame, a mobile, or other display capable of displaying a collectible 90. Light generating device 70 is disposed in a predetermined position relative to the display 82 to illuminate the displayed collectible 90. Light generating device 70 may be any light generating device, such as a light emitting diode, light bulb, laser light, or an optical fiber, that is capable of illuminating a collectible such that a user may identify the illuminated collectible.

The controller 60 includes a sound generating device 55, a light control 35, and a control module 105. Sound generating device 55 may be any device capable of accepting a sound control signal from the control module 105 and producing a predetermined audible sound corresponding to the sound control signal. Light control 35 may be any electrical wire, infrared generator, fiber optic cable or radio frequency transmitter system capable of accepting a signal from the control module 105 and illuminating a predetermined one of the light generating devices 70 on the display module. Control module 105 includes a user interface 15 that allows a user to choose a collectible and send a light control signal to a light control 35 and a sound control signal to the sound generating device 55. The light control and sound control signals simultaneously cause a corresponding light generating device 70 to illuminate the chosen collectible 90 and the sound generating device 55 to generate a predetermined sound that corresponds to the displayed collectible 90.

In operation, a user selects a desired collectible 90 from the user interface 15 of the control module 105. In response to the selection, the control module 105 simultaneously sends the light control signal to the light control 35 and the sound control signal to the sound generating device 55. The light control signal causes a corresponding one of the light generating devices 70 to illuminate the desired collectible 90 while the sound control signal causes the sound generating device 55 to generate a predetermined sound corresponding to the collectible 90.

Figure 2:
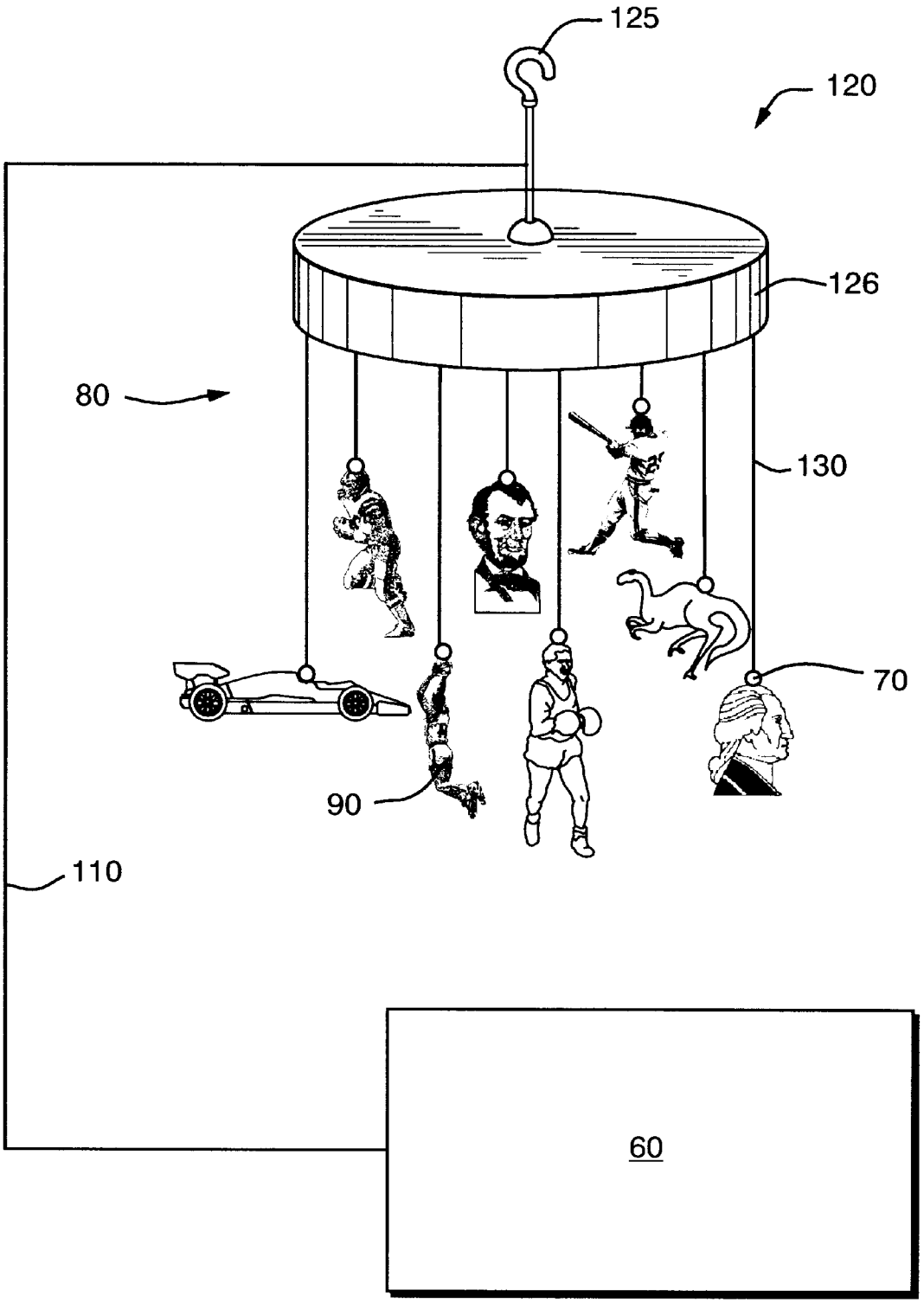
FIG. 2 is an isometric view of the preferred display of the apparatus of the present invention.

Referring now to FIG. 2, an isometric view of the preferred display module 80 of the present invention is shown. In the preferred display module 80, the display 82 is a mobile 120 that includes a plurality of hangers 130 for hanging collectibles 90 and a plurality of light generating device 70 for illuminating the collectibles 90. In this embodiment the light generating devices 70 may be attached directly to the collectible 90, located near the collectible 90, or integrated as part of the collectible 90. The mobile 120 can be suspended from a ceiling via a hook 125 or attached to a wall, not shown. The collectible 90 can be attached directly to the hangers 130 or can be placed on a platform or other holder attached to the hanger 130. It is preferred that the display 82 be directly connected to the controller using a wire cable 110 that places the controller 60 in electrical communication with each light generating device 70. In these embodiments, the hangers 130 may be structures, such as beams or tubes that can contain the wires Referring now to FIG. 3, a top isometric view of the preferred controller 60 is shown. In the preferred controller 60, the sound generating device 55 is a paper-cone type speaker 50 connected to a volume control device 20 for adjusting the volume of sound generated by the speaker 50, and the user interface is a keypad 10 through which a user selects a number corresponding to a given collectible and to a computer sound chip 30 connected to the controller. In other embodiments, however, the keypad 10 may be replaced by a plurality of switches, such as toggle, push-button, soft touch key pad, or any other type of on/off switch, with each switch corresponding to a removable computer sound chip 30.

Figure 3:
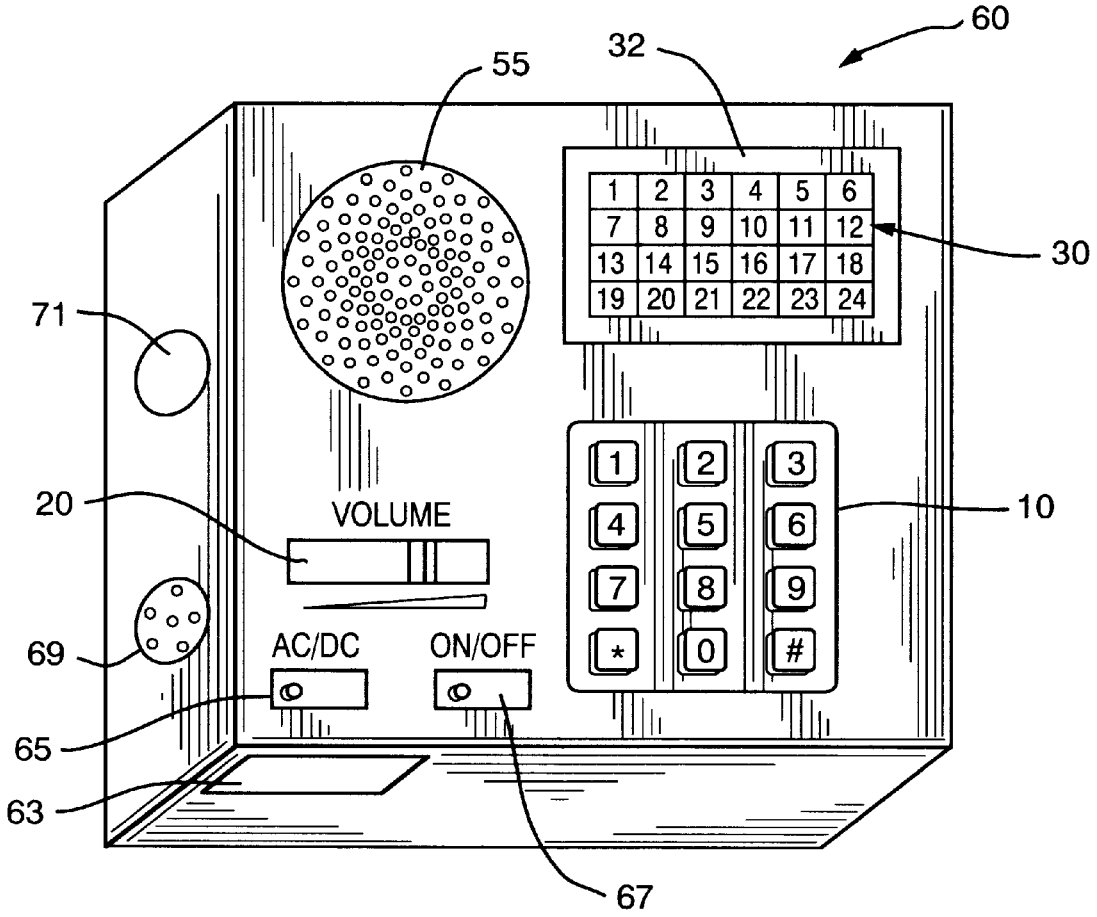
FIG. 3 is an isometric view of the preferred controller of the apparatus of the present invention.

As shown in FIG. 3, a plurality of sound chips 30 are disposed in numbered slots within a compartment 32 in the controller 60. 1however, in other embodiments, the sound chip 30 is a single memory chip, card, or other computer memory storage device 30, which stores all of the desired sounds. In some cases, these sounds may be recorded at the same time, while in others the sounds are recorded at different times. This recording may be accomplished either through the use of separate sound chips from which the sounds are recorded onto the sound chip 30, via a link with a personal computer, or through the use of a microphone attached to the controller 60. Each removable computer sound chip 30 is capable of generating the predetermined sound a predetermined number of times to function as a teaching method for users. In some embodiments, the computer sound chip also includes an integrated time delay circuit for delaying the transmission of the sound control signal a predetermined time after sending the light control signal, allowing the present invention to function as an interactive educational or entertainment tool. The delay allows an audience to comment on the displayed collectible before a pre-programmed sound or message describes the collectible.

The preferred controller 60includes a battery compartment 63 in which batteries (not shown) are disposed. The batteries may be utilized either to power the controller 60 during operation or to preserve the sounds recorded in the sound chip(s) 30 when the controller 60 is disconnected from AC power. As shown in FIG. 3, the controller 60 may be operated on either AC or DC power and a power switch 65 and ON/OFF switch 67 arc included to allow a user to switch back and forth between the two. The preferred controller 60 also includes a light cable port 69 that allows a light cable to be attached to the controller 60 via a standard multi-prong connector. Finally, a computer input port 71, such as the infrared port shown in FIG. 3, may be provided to allow sounds to be downloaded from a portable computer or other infrared transmitting device (not shown).

Figure 4:
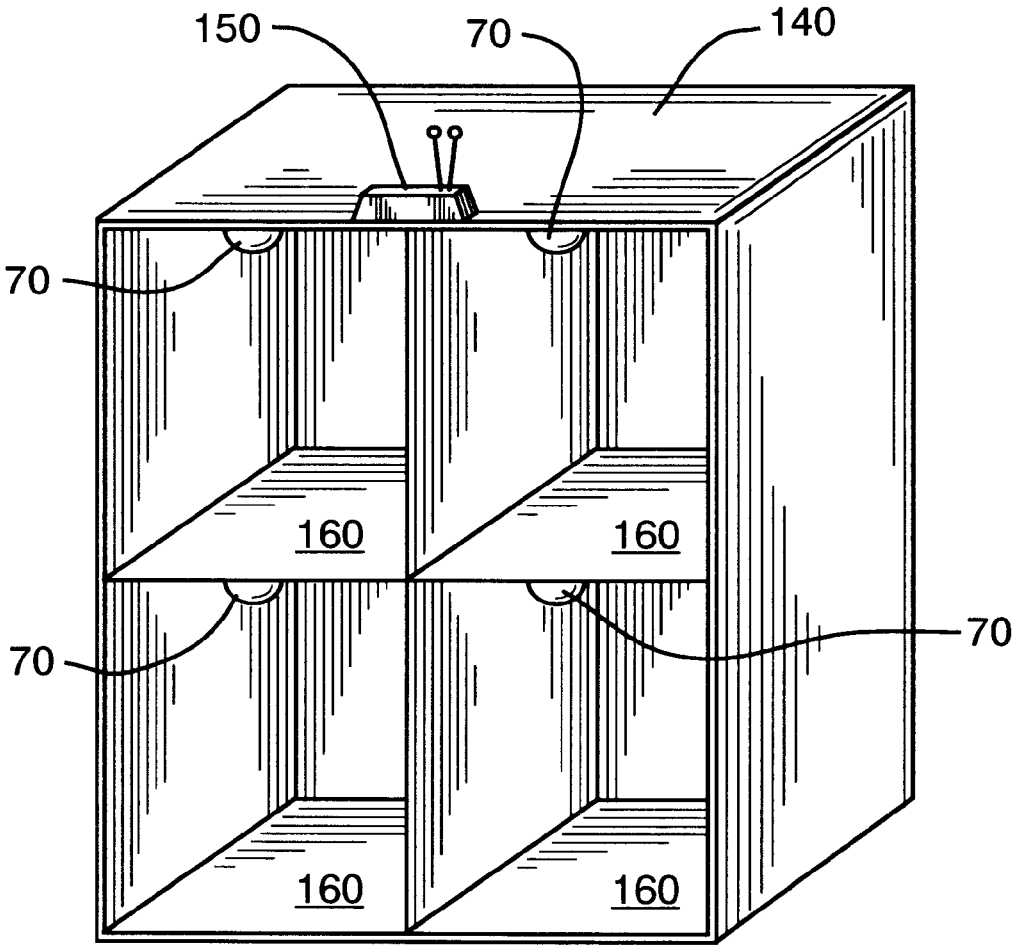
FIG. 4 is an isometric view of an alternate embodiment of the display of the present invention.

Referring now to FIG. 4, an isometric view of an alternate embodiment of the display module 80 is shown. In this embodiment, the display 82 is a wall mountable shelf unit 140. The shelf-unit 140 includes at least one compartment 160, dimensioned to house a predetermined collectible, at least one light generating device 70 to illuminate the corresponding compartment 160, and a remote light control.

The compartment 160 is dimensioned to allow a user to place the collectible 90 inside the compartment 160. In the embodiment of FIG. 4, the display 80 is a rectangular-shaped shelf-unit 140 with four compartments 160. However, the shelf-unit 140 can be triangular, hexagonal, square, trapezoidal or any suitable shape for displaying a predetermined collectible 90. The shelf unit 140 may even be formed in a shape that reflects the theme of the displayed collectible 90, such as the shape of a baseball bat, a shape of an automobile, or a shape of a displayed animal. It is preferred that the shelf-unit be made from wood. However, the shelf-unit can be manufactured from any suitable material or combination of materials, such as metal, glass, polymers, or laminated materials.

The light generating device 70 may be positioned at any location inside the compartment 160 that allows the device 70 to illuminate the displayed collectible 90. In the embodiment of FIG. 4, the light generating device 70 is attached to the compartment 160 above the displayed collectible 90. However, the light generating device 70 may be mounted on the outside of the shelf-unit 140 if, for example, the shelf unit is manufactured from glass or a transparent material. In addition, in some embodiments, the light generating device 70 is a two piece device including a light mounted within the collectible 90 and a socket or other plug mounted upon the display 82 for supplying power to the light within the collectible.

In the embodiment of FIG. 4, light control 35 is a remote light control including an infrared receiver 150 connected to the light generating devices 70 upon the display 82 and an infrared transmitter, not shown, mounted upon the control module 105 (as described with reference to FIGS. 1 and 3). However, other remote light controls, such as radio-frequency controls or the like, may be substituted to achieve similar results. In the embodiment of FIG. 4, infrared receiver 150 is a commercially available infrared receiver that is capable of receiving a signal from the infrared transmitter and activating a light generating device 70 to illuminate the desired collectible 90 (not shown).

Figure 5:
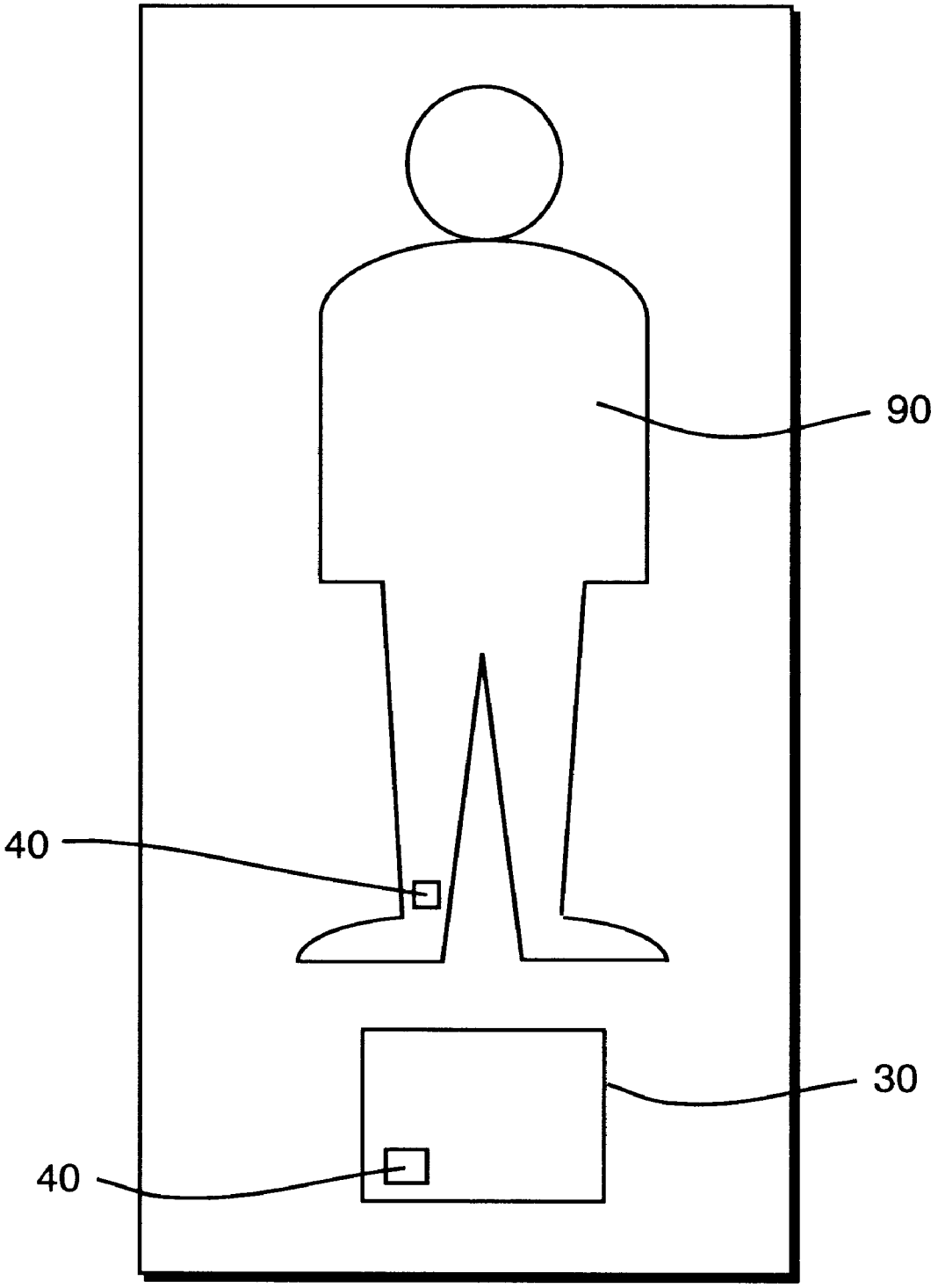
FIG. 5 is an isometric view of the kit of the present invention.

Referring now to FIG. 5, a kit for use with the apparatus of the present invention is shown. The kit of the present invention includes a collectible 90 and a computer sound chip 30 corresponding to the collectible. The kit of the present invention is intended to be used with the apparatus such that a collector may obtain a plurality of collectibles 90 and corresponding sound chips 30 to make up a desired set.

In some embodiments, the computer sound chips 30 and collectibles 90 may be identified by identification markings 40, which properly correlate a given computer sound chip 30 to the corresponding displayed collectible 90. The identification marking 40 may be placed at any location on the collectible 90 and computer sound chip 30, that is visible to the user. The identification marking 40 often states the name of the displayed collectible 90, such as "Joe Smith", for a baseball player figurine. By properly identifying the collectibles 90 and computer sound chips, the user may place the collectible 90 on the display 82 in a location proximate a light generating device that corresponds to the location upon the controller corresponding to that light generating device. In this manner, collectibles 90 may be moved to different locations about the display 82, or replaced by other collectibles, and computer sound chips 30 may be moved to corresponding locations, or removed such that the proper sound will be generated when the predetermined light generating device is illuminated. In addition, new computer sound chips 30, containing updated information about a collectible, may replace old sound chips 30 in order to provide current information about the collectible 90 being displayed. This updated information may include, for example, a basketball player's statistics from the prior season or newly discovered biographical material about a historic figure.

As noted above, the collectibles 90 and sound chips 30 may relate to any area of interest including sports, history, movies, music, archeology, paleontology, zoology, geography, literature, art, philately, or any other interest in which the experience of collecting collectibles 90 may be enhanced through an audible sound or explanation. In addition, it is contemplated that the apparatus and kit of the present invention may be useful as a classroom teaching tool or for use in museums or other places where objects are displayed. Finally, the interactive nature of the apparatus and kit allow the present invention to be attractive both to small children and adults.

Although the present invention has been described in considerable detail with reference to certain preferred versions thereof, other versions would be readily apparent to those of ordinary skill in the art. Therefore, the spirit and scope of the appended claims should not be limited to the description of the preferred versions contained herein.

What is claimed is:

1. An apparatus for displaying at least one collectible, said apparatus comprising:

a display dimensioned for receiving said at least one collectible;

at least one light generating device for illuminating said collectible when received within said display; and a controller comprising;

a sound generating device for generating at least one predetermined sound;

a light control for activating a predetermined one of said at least one light generating device corresponding to said one of said at least one predetermined sound;and a control module having a user interface for sending a light control signal to said light control and a sound control signal to said sound generating device, said light control signal and said sound control signal each corresponding to a collectible selected by a user;

wherein a user selects a desired collectible on said user interface and said control module sends a control signal to said light control and to said sound generating device causing a corresponding one of said at least one light generating device to illuminate said desired collectible and causing said sound generating device to generate one of said at least one sound corresponding to said desired collectible.

2. The apparatus as claimed in claim 1, wherein said control module further comprises at least one removable computer sound chip, each of said at least one removable computer sound chip being programmed with one of said at least one predetermined sound.

3. The apparatus as claimed in claim 2, wherein said control module comprises a plurality of removable computer sound chips and wherein said user interface comprises a plurality of switches, wherein each of said plurality of switches corresponds to one of said plurality of removable computer sound chips.

4. The apparatus as claimed in claim 3, wherein an identification marking is disposed on each of said plurality of removable computer sound chips to correlate each of said plurality of removable computer sound chips with a corresponding collectible.

5. The apparatus as claimed in claim 2 wherein said sound generating device comprises at least one speaker in communication with said at least computer sound chip and a volume control device for adjusting a volume of sound generated by said sound generating device.

6. The apparatus as claimed in claim 1, wherein said control module delays sending said sound control signal for a predetermined time after sending said light control signal.

7. The apparatus as claimed in claim 1, wherein said control module sends a series of sound signals to generate said one of at lest one predetermined sound a predetermined number of times.

8. The apparatus as claimed in claim 1 wherein said light control comprises at least one wire connected from said control module to at least one light generating device.

9. The apparatus as claimed in claim 1 wherein said light control comprises at least one fiber optic cable connected from said control module to at least one light generating device.

10. The apparatus as claimed in claim 1, wherein said light control comprises an infrared generator, mounted upon said control module, for generating an infrared signal and an infrared receiver, connected to each of said at least one light generating device, for receiving said infrared signal and activating a predetermined one of said at least one light generating device.

11. The apparatus as claimed in claim 1, wherein said light control comprises a radio frequency generator, mounted upon said control module, for generating a radio frequency signal and a radio frequency receiver, connected to each of said at least one light generating device, for receiving said radio frequency signal and activating a predetermined one of said at least one light generating device.

12. The apparatus as claimed in claim 1 wherein said display comprises a mobile for removably hanging a plurality of collectibles, wherein said mobile comprises a plurality of hangers, and wherein each of said plurality of hangers is attached to one of said at least one light generating device.

13. The apparatus as claimed in claim 1 wherein said display comprises a shelf unit having at least one compartment dimensioned to receive at least one collectible, and wherein one of said at least one light generating device is disposed within each of said at least one compartment.

14. A kit of parts for forming a decoration, said kit comprising:

a collectible dimensioned to be received by a display; and a computer sound chip programmed with a predetermined sound corresponding to said collectible;

wherein said collectible may be disposed upon said display and said computer sound chip may be connected to a sound generating device such that said predetermined sound corresponding to said collectible is played.

15. The kit as claimed in claim 14, wherein an identification marking is disposed upon said removable computer sound chip and upon said collectible to properly correlate said removable computer sound chip with said collectible.

16. The kit as claimed in claim 14, further comprising a controller having a user interface and a sound generating device, said controller being capable of reading said predetermined sound programmed into said computer sound chip and playing said predetermined sound through said sound generating device.

17. The kit as claimed in claim 16 further comprising said display and wherein said display comprises at least one light generating device for illuminating said collectible.

18. The kit as claimed in claim 17, wherein said controller further comprises a light control for activating a predetermined one of said at least one light generating device corresponding to said predetermined sound.

19. The kit as claimed in claim 18 wherein said light control is adapted to be directly connected from said control module to each of said at least one light generating device.

20. The kit as claimed in claim 18 wherein said light control is adapted to remotely control each of said at least one light generating device.

* * * * *